United States Patent [19]

Anderson

[11] Patent Number: 4,484,830

[45] Date of Patent: Nov. 27, 1984

[54] LOOSE-LEAF BINDER

[76] Inventor: Kenneth Anderson, 214 Indian Rd., Toronto, Ontario Canada, M6R 2W6

[21] Appl. No.: 387,727

[22] Filed: Jun. 11, 1982

[51] Int. Cl.[3] ..... B42F 13/00; B42F 13/16

[52] U.S. Cl. ..... 402/77; 402/76; 402/80 P

[58] Field of Search ..... 402/75, 76, 77, 74, 402/73, 68, 63, 80 P, 49, 70, 78; 206/545; 281/29, 33; 150/1.6, 11

[56] References Cited

U.S. PATENT DOCUMENTS

| | | | |
|---|---|---|---|
| 3,111,949 | 11/1963 | Duncan et al. | 402/74 X |
| 3,132,649 | 5/1964 | Gits | 281/29 X |
| 3,251,364 | 5/1966 | Goldman | 402/80 P |
| 3,260,264 | 7/1966 | McKowen | 402/80 P |
| 3,313,304 | 4/1967 | Beyer | 402/80 P |
| 3,891,070 | 6/1975 | Montanari | 402/76 X |
| 4,294,558 | 10/1981 | Errichiello | 402/75 |
| 4,307,972 | 12/1981 | Errichiello | 402/73 |
| 4,340,316 | 7/1982 | Jahn | 402/80 P X |

*Primary Examiner*—Paul A. Bell

*Attorney, Agent, or Firm*—Rogers, Bereskin & Parr

[57] ABSTRACT

A loose-leaf binder for storing standard loose-leaf pages is described. The binder includes a cover comprising upper and lower cover members which are integrally formed by injection molding of a thermoplastic material. An inner surface of the lower cover member is integrally molded with a plurality of posts which receive and align the pages to be stored. In a preferred embodiment, the pages are retained by means of a plurality of arched members which are mounted on an axle that snap fits into a plurality of axle mounts molded with the inner surface of the lower cover member. The mounting means permit pivoting of the axle between a first position in which each of the arch members engages a corresponding post and a second position in which the arch members are removed from the posts.

3 Claims, 6 Drawing Figures

FIG. 5
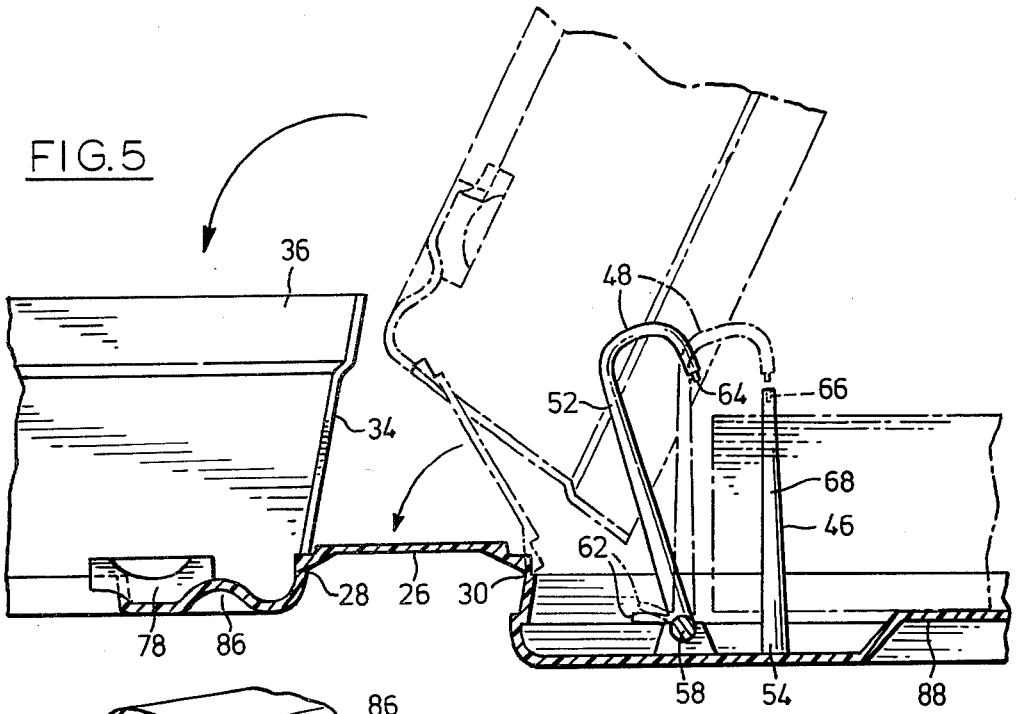
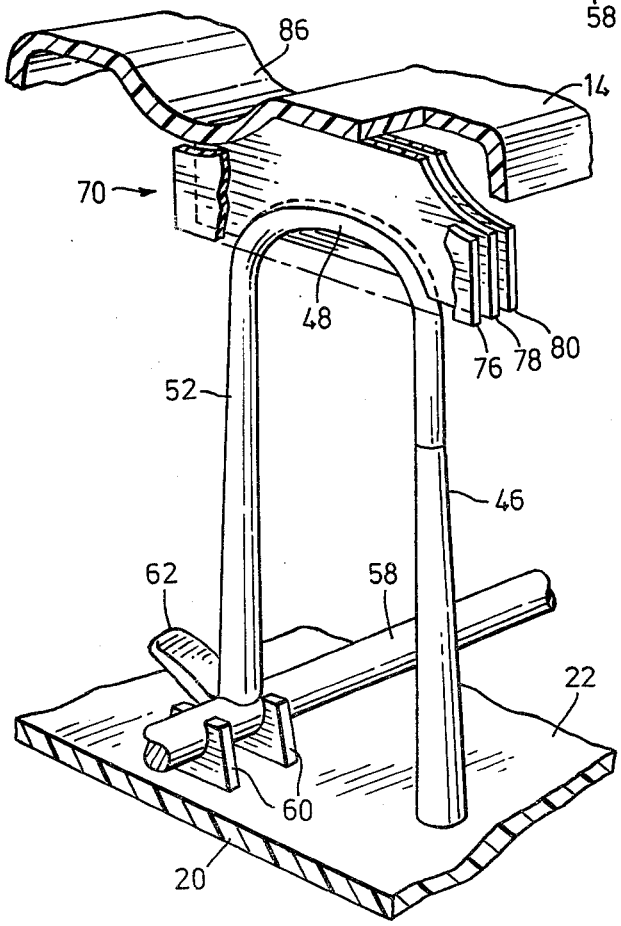
FIG. 6

LOOSE-LEAF BINDER

FIELD OF THE INVENTION

The invention relates to loose-leaf binder which stores standard sheets of loose-leaf paper.

BACKGROUND OF THE INVENTION

In present practice, it is commcn to manufacture a loose-leaf binder with a cover consisting of a top cover member, bottom cover member and a narrow spine or bridging member. The bridging member is connected to the top cover member at a first hinge line, and to the bottom cover member at a second hinge line to permit the cover to lay flat when opened. A metal binder assembly (usually of the three-ring type) is riveted or otherwise fixed to either the bridging member or the bottom cover member. There are several problems associated with such manufacture. First, considerable labour may be involved in forming the cover members (although the practice has arisen of integrally forming the cover members by cutting the cover from a sheet of plastic material). Second, a metal binder assembly is relatively expensive, and some manipulation of such an assembly is required during securement to a cover, making manufacture not altogether simple.

It is an object of the invention to provide a loose-leaf binder with a basic construction that is simple to manufacture and assemble.

It is also an object of the invention to provide various features which make a loose-leaf binder a more effective tool for use by a commuter who may wish to work during transit in limited space without interfering with other commuters. In a preferred embodiment, various features are provided to permit better organization and use of loose-leaf materials.

BRIEF SUMMARY OF THE INVENTION

The invention provides a loose-leaf binder for storing pages having a plurality of holes spaced apart in a predetermined arrangement. The binder includes a cover which includes first and second cover members both having inner and outer surfaces. The cover members are hingedly connected to permit the cover to be hingedly moved between a closed orientation in which the inner surfaces of the cover members can be located about loose-leaf pages and an open orientation in which the pages can be accessed. A plurality of substantially parallel posts are injection molded with the inner surface of the second cover member and are spaced apart in the predetermined arrangement so that the pages can be located on the posts. Page retaining means which can take a variety of forms releasably attach to the posts to secure the pages.

The page retaining means preferably comprise a number of arched members mounted on an axle, and axle mounting means injection molded with the inner surface of the second cover member. The mounting means are such that the axle can be rotated between a first postion in which each of the arched members engages a corresponding post, and a second position in which the arch members are clear of the posts to permit receipt or removal of loose-leaf pages. The arched members are preferrably formed of a resilient plastic material, and one of the arched members with a stud or projection which inserts into a recess in the corresponding post to lock the axle in the first position. The thermoplastic material of the arched members is selected to be so resilient that the axle can be unlocked by momentarily deforming the one of the posts in an elastic manner to disengage the stud from the recess. With the mounting means preferrably formed with a recess shaped to grip axle surface portions, the arched members and axle assembly can be snap fit into place.

DESCRIPTION OF THE DRAWINGS

Various objects and advantages of the invention will be better understood with reference to drawings in which:

FIG. 5 is a fragmented, cross-sectional view illustrating the hinging of the loose-leaf binder, and also portions of a binder assembly; and, FIG. 6 is an extensively fragmented, perspective view illustrating an arched member and post of the binder assembly together with a saddle structure which reinforces the loose-leaf binder in the closed orientation.

DETAILED DESCRIPTION OF PREFERRED EMBODIMENT

Figure 1:
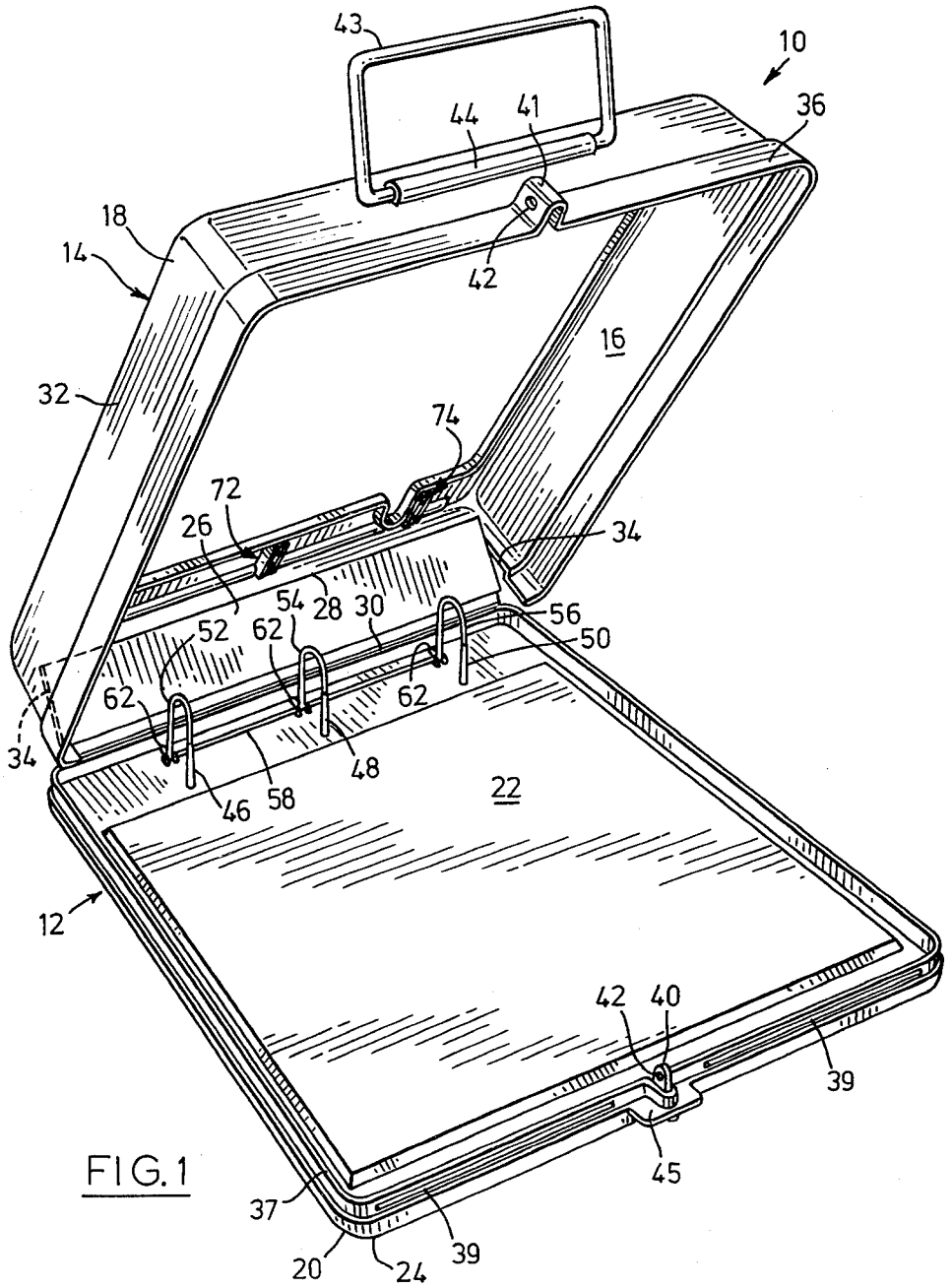
FIG. 1 is a perspective view of a preferred embodiment of the loose-leaf binder in an open orientation.
Figure 2:
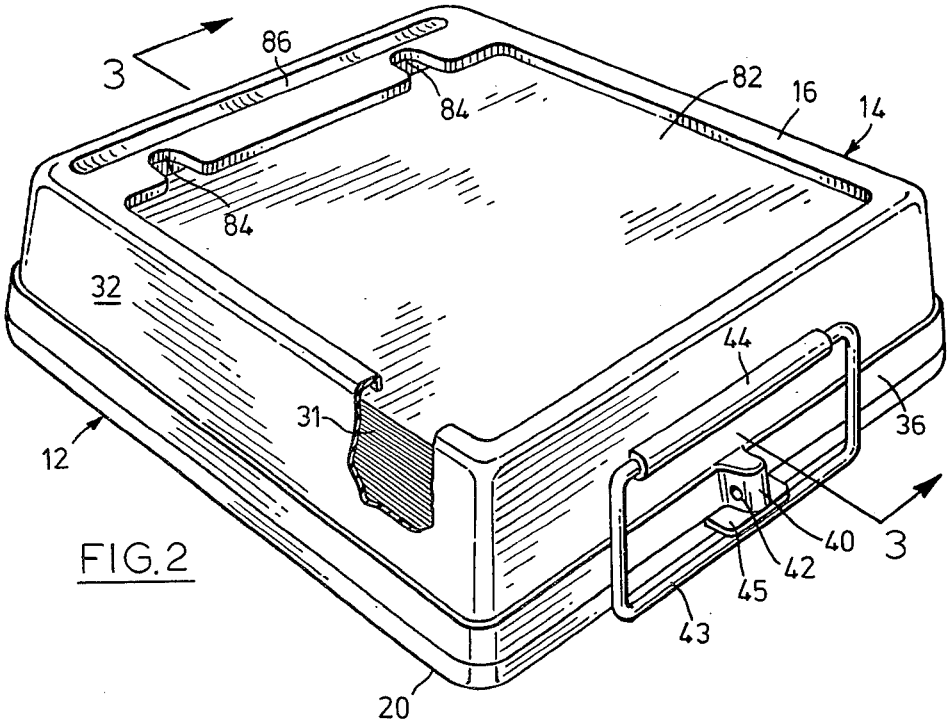
FIG. 2 is a fragmented, perspective view of the loose-leaf binder in a closed orientation.
Figure 3:
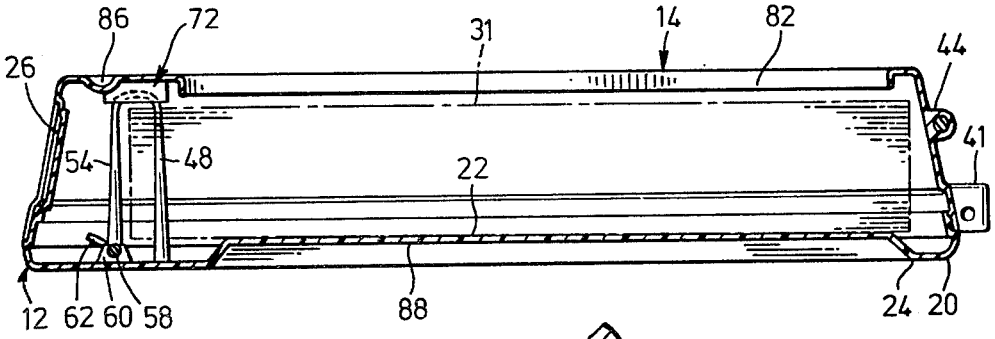
FIG. 3 is a cross-sectional view along the lines 3—3 of FIG. 2 illustrating interior construction of the loose-leaf binder.

A preferred embodiment 10 of a loose-leaf binder constructed according to the invention will be described with reference to FIGS. 1–6. The binder 10 has a cover 12 which is injection molded of polypropylene. The cover 12 includes a first, upper cover member 14 having an inner surface 16 and an outer surface 18. The cover 12 also includes a second, lower cover member 20 with an inner surface 22 and outer surface 24. A spine or bridging member 26 is integrally connected to the upper cover member 14 along a first hinge line 28, and is integrally connected to the lower cover member 20 along a second hinge line 30. This arrangement permits the cover to open from the closed position illustrated in FIG. 2 to an open position in which the upper and lower cover members 14, 20 can both be laid flat on a work surface such as a desk.

Figure 4:
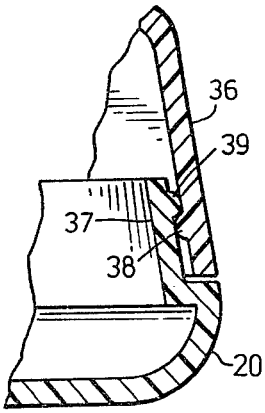
FIG. 4 is an enlarged, cross-sectional view detailing certain structure including a locking mechanism, all of which is generally indicated by the reference numberal 4 in FIG. 3.

The cover 12 is dimensioned to contain standard $8\frac{1}{2}'' \times 11''$ loose-leaf sheets. The upper cover member 14 is formed with a side wall 32 which extends continuously around three sides of the cover 12, and terminates at the ends 34 adjacent ends of the bridging member 26. A skirt 36 is integrally molded with and extends continuously about the bottom of the side wall 32. The skirt 36 is dimensioned to fit about a circumferential, upwardly extending lip 37 of the lower cover member 20 when (as illustrated in FIG. 4) the cover 10 is closed. A pair of internal, longitudinal ribs 38 molded with the skirt 36 snap fit over a corresponding pair of external longitudinal ribs 39 formed on the lip 32 to releasably lock the cover 12 in a closed orientation. In the closed position, an apertured post 40 molded with the lower cover member 20 is received in an apertured hood 41 molded with the upper cover member 14, with their apertures 42 in registration. The cover 12 can then be padlocked if desired by inserting a lock through the registered apertures 42. A handle 43 pivotally fitted in a cylindrical sleeve 44 which is adhesively bonded to the upper cover member 14 can be used to carry the the binder 10 and its contents. To separate the snapfitting ribs 38, 39, a user can draw the upper cover member 14 upwardly by means of the handle 43 while bearing down against a finger plate 45 molded with the lower cover member 20.

The binder 10 is provided with a binder assembly of relatively simple construction which is inexpensive to manufacture and easy to install. The binder assembly includes three posts 46, 48, 50 which are injection molded with the inner surface 22 of the lower cover member 20. The posts 46, 48, 50 are generally parallel, in-line and spaced to conform to the standard spacing of holes normally provided in conventional $8\frac{1}{2}''\times 11''$ loose-leaf paper. The posts can of course be oriented in any predetermined spacing arrangement and in any predetermined numbers to receive any appropriately apertured loose-leaf pages.

The binder assembly includes three arched members 52, 54, 56 which are integrally molded with a circular, cylindrical axle 58. The axle 58 snap fits into four axle mounts 60 which are projections molded with the inner surface 22 of the lower cover member 20, and which are formed with circular recesses dimensioned to retain the axle 58 while still permitting pivoting. The axle 58 can be pivoted by hand between a first position illustrated in FIG. 1 in which the arched members 52, 54, 56 engage corresponding posts and a second position illustrated in FIG. 5 in which the arched members 52, 54, 56 are displaced from the corresponding posts. Three dog legs 62 molded with the axle 58 limit pivoting of the arched members 52, 54, 56 beyond the position illustrated in FIG. 5.

The central post 48 and the corresponding central arched member 54 (detailed in FIG. 5) are adapted to releasably lock the axle 58 in the first position, in which loose-leaf pages cannot be released from the posts 46, 48, 50. To this end, the central arched member 54 is formed with a plug or stud 64 of generally circular, cylindrical shape having a length of about 2 mm, which can be seated in a recess 66 of corresponding shape formed in a portion 68 of the post 48 distal from the inner surface 22 of the lower cover member 20. The stud 64 can be removed from the recess 66 to unlock the axle 58 by elastically deforming the central arched member 54 upwardly to the position illustrated in stippled outline in FIG. 5.

The posts and arched members are relatively flexible, and reinforcement is provided to ensure that loading of the posts by contained loose-leaf paper when the cover 12 is carried vertically or rested on its side does not deform the posts or arched members. This reinforcement is in the form of three substantially identical saddles 70, 72, 74 which are molded with the inner surface 16 of the upper cover member 14 and which locate about upper, arched portions of the arched members 52, 54, 56 when the cover 12 is closed. The saddle 70, which is typical, is illustrated in detail in FIG. 6. The saddle 70 is constructed in three generally parallel plate-shaped members 76, 78, 80. The outer members 76, 80 locate one on either side of the arched upper portion of the arched member 52, and the central member 74 is formed with a lower edge which conforms in shape to the arched top of the arched member 52. As the cover 12 is closed, the saddles 70, 72, 74 contact the corresponding arched members 52, 54, 56, when the upper and lower cover members are displaced apart 2–3 mm from a fully locked position. With the cover 12 closed, deflection of the posts and arched member is prevented. The reinforcement provided by the saddles 70, 72, 74 together with the mild prestressing of the binder assembly tend to reduce creep characteristic of the polypropolene, and consequently preserve the shape of the arched members and posts.

The upper cover member 14 is constructed with a shallow well 82 with a nominal depth of about 5 mm and otherwise dimensioned to receive standard $8\frac{1}{2}''\times 11''$ loose-leaf pages. The well 82 provides a proper writing surface upon which a commuter, for example, can work during transit. A pair of grooves 84 whose bottoms are flush with the bottom of the well 82 permit a user to locate his finger against the side edges of pages contained in the well 82 to facilitate the removal of pages. An additional groove 86 serves as means for retaining a pencil, pen or the like during use of the binder 10 as a surface upon which to write.

The outer surface 24 of the lower cover member 20 is also formed with a well 88 similar to the well 82. The inner surface 22 of the lower cover member 20 consequently has a surface upon which pages retained on the posts 46, 48, 50 can be rested, and could consequently serve as a writing surface, if the lower cover member 20 were made relatively shallow. However, the primary purpose of the well 88 is to add to the structural rigidity of the cover 12.

It will be appreciated that many variations may be made in the preferred embodiment illustrated without departing from the spirit of the invention and the scope of the appended claims. For example, a slimmer version of the device 10 can be produced by eliminating the bridging member 26, and providing simply a single hinge line between the upper and lower cover members 14, 20. To permit such a slimmer construction, the arched members 52, 54, 56 can be eliminated and replaced, for example, with lock flaps constructed of one inch wide strips of plastic material. These strips can be heat welded or adhesively secured at one end portion to the lower cover member, and provided with an aperture in an opposite end portion so that the strips can be located over a post. The post can then be provided with an annular ring marginally larger than the aperture in a particular flap so that the flap can be retained when the aperture is about the post. The posts injection molded with the lower cover member could accordingly be made much shorter to accommodate the thinness of the cover. Additionally, the cover members need not be constructed to provide a substantially sealed housing, but can be constructed to more closely resemble the planar cover members common to most conventional loose-leaf binders. A single hinge line can in such circumstances be employed in joining the cover members, and the cover members can be appropriately shaped adjacent the hinge line to permit both cover members to lie flat on a desk surface or the like when the cover is opened.

I claim:

1. A loose-leaf binder for storing pages which have a plurality of holes spaced apart in a predetermined arrangement, comprising:

a cover including a first cover member with inner and outer surfaces and a second cover member with inner and outer surfaces, the first and second cover members hingedly connected whereby the cover members are hingedly movable between a closed orientation in which the inner surface of the cover members can be located about the pages and an open orientation on which the pages can be accessed, the second cover member molded of a thermoplastic material;

a plurality of substantially parallel posts injection molded with the inner surface of the second cover member and spaced apart in the predetermined arrangement so that the posts can be inserted into the holes of the pages;

page retainment means releasably securable to the posts to prevent removal of pages received on the posts, the page retainment means including a plurality of arched members mounted on an axle and axle mounting means attached to the inner surface of the second cover member for retaining the axle in pivoting engagement, the axle mounting means adapted to permit pivoting of the axle between a first position in which each of the arched members engages a corresponding different one of the posts at a post portion distal from the inner surface of the second cover member and a second position in which none of the arched members engages the posts;

one of the arched members being formed with a stud, and the corresponding one of the posts being formed with a recess dimensioned to receive the stud to lock the axle in the first position, and at least the one of the arched members being formed of a plastic material sufficiently resilient to permit the arched member to be momentarily deformed in an elastic manner to permit removal of the stud from the recess in the corresponding one of the posts;

lock means for releasably locking the first cover member to the second cover member in the closed orientation; and, reinforcement means secured to the inner surface of the first cover member for engaging at least the one of the arched members when the cover is hingedly moved into the closed orientation to prevent deflection of at least the one of the arched members relative to the inner surface of the second cover member.

2. A loose-leaf binder as claimed in claim 1 in which each of the arched members is formed of the resilient plastic material and in which the reinforcement means include a plurality of saddles, each of the saddles cooperating with a different one of the arched members, which saddles seat about an arched portion of the associated arched members when the cover is hingedly moved into the closed orientation to prevent deflection of the arched members relative to the inner surface of the second cover member.

3. A loose-leaf binder as claimed in claim 1 in which the reinforcement means comprise a saddle which seats about an arched portion of the one of the arched members when the cover is hingedly moved into the closed orientation.

* * * * *